US008916255B2

(12) United States Patent
Wakata et al.

(10) Patent No.: US 8,916,255 B2
(45) Date of Patent: Dec. 23, 2014

(54) FASTENER TAPE AND FASTENER STRINGER

(75) Inventors: Syuji Wakata, Toyama (JP); Masahiro Nakamura, Toyama (JP); Yasushi Yamamoto, Toyama (JP)

(73) Assignee: YKK Corporation (JP)

( * ) Notice: Subject to any disclaimer, the term of this patent is extended or adjusted under 35 U.S.C. 154(b) by 204 days.

(21) Appl. No.: 13/637,726

(22) PCT Filed: Mar. 29, 2010

(86) PCT No.: PCT/JP2010/055567

§ 371 (c)(1),
(2), (4) Date: Sep. 27, 2012

(87) PCT Pub. No.: WO2011/121702

PCT Pub. Date: Oct. 6, 2011

(65) Prior Publication Data

US 2013/0022778 A1 Jan. 24, 2013

(51) Int. Cl.

| | |
|---|---|
| ***A44B 19/24*** | (2006.01) |
| ***A44B 19/34*** | (2006.01) |
| ***D04B 21/16*** | (2006.01) |

(52) U.S. Cl.

CPC ..... *A44B 19/343* (2013.01); *D04B 21/16* (2013.01); *D10B 2501/0631* (2013.01)

USPC ..... 428/99; 24/381

(58) Field of Classification Search

CPC ..... A44B 19/24

USPC ..... 428/99, 156; 24/381

See application file for complete search history.

(56) References Cited

U.S. PATENT DOCUMENTS

| | | | |
|---|---|---|---|
| 3,926,017 | A | 12/1975 | Matsuda |
| 4,067,208 | A | 1/1978 | Heimberger |
| 5,586,454 | A | 12/1996 | Matsuda et al. |
| 2004/0244157 | A1 | 12/2004 | Matsuda |

FOREIGN PATENT DOCUMENTS

| | | | |
|---|---|---|---|
| AT | 814274 | A | 3/1979 |
| AU | 7415774 | A | 4/1976 |
| BE | 820931 | A | 2/1975 |
| BE | 820931 | A1 | 2/1975 |
| CA | 1006366 | A | 3/1977 |
| CH | 569441 | A | 11/1975 |
| CN | 1572173 | A | 2/2005 |

(Continued)

OTHER PUBLICATIONS

International Search Report, PCT Application No. PCT/JP2010/055567, mailed Jun. 22, 2010.

*Primary Examiner* — Alexander Thomas

(74) *Attorney, Agent, or Firm* — Kilpatrick Townsend & Stockton LLP

(57) ABSTRACT

A fastener tape includes a tape main body portion and an element attachment portion in which a core thread is knitted. The tape main body portion includes a first tape main body portion region at the element attachment portion and a second tape main body portion region. A wale interval between a wale of the element attachment portion adjacent to the first tape main body portion region and a wale constituting the first tape main body portion region is narrower than that of the second tape main body portion region. Therefore, while the flexibility of the second tape main body portion region is ensured, a tape strength and an abrasion resistance are improved, and further, when a fastener element is formed, this prevents resin leakage through knitted loops of the element attachment portion.

8 Claims, 3 Drawing Sheets

(56) References Cited

FOREIGN PATENT DOCUMENTS

| | | | |
|---|---|---|---|
| DE | 2449286 | A | 4/1975 |
| DE | 2626663 | A | 12/1977 |
| DK | 255377 | A | 12/1977 |
| EP | 1481602 | A1 | 12/2004 |
| ES | 206851 | Y | 7/1976 |
| FI | 771570 | A | 12/1977 |
| FR | 2249200 | A | 4/1975 |
| GB | 1472614 | A | 5/1977 |
| HK | 37378 | A | 7/1978 |
| HK | 1069511 | A | 1/2007 |
| IT | 1020983 | B | 12/1977 |
| IT | 8573907 | | 12/1977 |
| IT | 8768101 | | 12/1977 |
| IT | 8768101 | | 12/1987 |
| JP | 48-32224 | B1 | 10/1973 |
| JP | 50-66806 | | 6/1975 |
| JP | 54-35767 | | 10/1979 |
| JP | 55-148409 | | 10/1980 |
| JP | 63-91011 | | 6/1988 |
| JP | 63-103311 | | 7/1988 |
| JP | 8-56713 | | 3/1996 |
| JP | 2004-351085 | A | 12/2004 |
| KR | 20-1990-0004717 | Y | 12/1977 |
| KR | 10-2004-0103311 | A | 12/2004 |
| MY | 8479 | A | 12/1975 |
| NL | 7413854 | A | 10/1974 |
| SE | 7412953 | A | 5/1975 |
| SE | 7704573 | A | 1/1978 |
| TW | 248799 | B | 2/2006 |

FASTENER TAPE AND FASTENER STRINGER

This application is a national stage application of PCT/JP2010/055567 which is incorporated herein by reference.

TECHNICAL FIELD

The invention relates to a fastener tape for a slide fastener in which a core thread is knitted into an element attachment portion, and more particularly, to a fastener tape and a fastener stringer made using the fastener tape, wherein the strength of a tape region of a tape main body portion at the side of an element attachment portion is improved, and further, when a fastener elements are knitted into the element attachment portion, resin leakage can be prevented.

BACKGROUND ART

In recent years, slide fasteners are attached to various kinds of flexible clothes, and a fastener tape itself is often required to have flexibility. Therefore, various kinds of knitted fastener tapes which are more flexible than woven fabrics have been developed. In particular, from the viewpoint of flexibility and excellent stability of form, fastener tapes having warp knitting structure are now widely used.

When a fastener stringer is made by knitting a synthetic resin or metallic fastener elements on a fastener tape, or when a fastener stringer is made by swaging and fixing a metallic fastener elements to a fastener tape, a core thread is generally provided in an element attachment portion of the fastener tape in order to improve attachment strength of the fastener elements to the fastener tape. In particular, when a core thread is arranged in the element attachment portion of the fastener tape having the warp knitting structure as described above, the core thread is knitted into the element attachment portion at the same time as knitting of the fastener tape.

As described above, for example, Patent Document 1 and Patent Document 2 disclose inventions relating to fastener tapes having warp knitting structure wherein a core thread is knitted into the element attachment portion.

Patent Document 1 discloses a fastener tape knitted with a single row needle wherein a core thread is knitted into an element attachment portion. This fastener tape is knitted using three kinds of knitting yarns having different structures, i.e., a chain knitting yarn, a tricot knitting yarn, and a single cord knitting yarn, and a core thread is inserted and knitted between both sinker loops of the single cord knitting yarn and the tricot knitting yarn of the element attachment portion.

According to the fastener tape, a textured yarn is used as the single cord knitting yarn, and the tension of the tricot knitting yarn is more than the tension of the single cord knitting yarn. This causes difference of tension between the sinker loop of the tricot knitting yarn and the sinker loop of the single cord knitting yarn, so that the core thread is pressed to the side of the single cord knitting yarn, and the bulging shapes of portions where the core thread is knitted becomes symmetrical on the front surface and the back surface of the fastener tape.

Therefore, when the metallic fastener elements are swaged and attached to the fastener tape, this can prevent the attachment portion of the fastener elements from being displaced from a central portion in a front/back direction of the tape (direction of the thickness of the tape).

Patent Document 2 discloses a fastener tape knitted by a double interlock knitting machine having front row needles and rear row needles and capable of knitting a double structure with the needles. This fastener tape includes a tape main body portion and an element attachment portion in which a core thread is arranged in a central portion in a front/back direction of the tape. The tape main body portion of the fastener tape is knitted by the rear row needles, and the base structure of the tape main body portion includes a chain knitting yarn, a tricot knitting yarn, and a first inserted weft yarn inserted between four wales in a zigzag manner.

On the other hand, the element attachment portion of the fastener tape is knitted as a double structure. In addition, this element attachment portion includes two rows of wales, and a core thread is arranged between the two rows of wales. The knitting structure of the element attachment portion includes a chain knitting yarn knitted in the front and the back of the tape and two second inserted weft yarns inserted between two wales in a zigzag manner and arranged symmetrically on the front and the back of the tape. The core thread is arranged between the two second inserted weft yarns arranged on the front and the back of the tape.

In this kind of element attachment portion in Patent Document 2, the chain knitting yarn is arranged on the front surface side of the tape and the back surface side of the tape of the two rows of wales with the core thread sandwiched therebetween, and the two rows of wales are pulled by two second inserted weft yarns. Therefore, the element attachment portion has a cross section in a substantially rectangular shape as a whole, and the core thread is held at a substantially central portion by the chain knitting yarn arranged on the front surface side of the tape and the back surface side of the tape of each wale and the two second inserted weft yarns inserted between two rows of wales.

Accordingly, when the metallic fastener elements are swaged and attached to the element attachment portion of the fastener tape, a leg portion of the fastener element is deeply engaged with the element attachment portion of which cross section is in substantially rectangular shape, so that the fastener elements can be rigidly attached to a predetermined position. Therefore, the attached fastener elements are less likely to be detached from the element attachment portion, and this effectively prevents the position of the fastener elements from being displaced in the tape length direction of the fastener tape.

By the way, the fastener tape having the knitting structure is generally superior in flexibility, but as compared with, for example, woven fastener tape, the yarn density is smaller, and the strength of the tape is lower. Therefore, the slide fastener structured using the fastener tape of the knitting structure receives sideway pulling force, the fastener tape is partially cut or split.

Further, when a slide fastener is made with the knitted fastener tape, a flange of the slider may slide on and come into contact with the fastener tape when the slider is moved and slid, and therefore, the knitting yarn in the tape region arranged on a region on which the flange of the slider passes is likely to be cut by friction, and there is a drawback in that there is only a low degree of abrasion resistance caused by sliding movement of the slider.

In order to solve the above drawback of the fastener tape having the knitting structure, for example, Patent Document 3 discloses a fastener tape wherein an interval between a first wale arranged at an edge of a tape of an element attachment portion side and a second wale adjacent to the first wale is set at an interval wider than a wale interval of a tape main body portion, and a wale from the second wale to a predetermined wale is closer than the other wales.

In the fastener tape according to Patent Document 3, no core thread is arranged in the element attachment portion like the fastener tape of Patent Document 1 and Patent Document 2, and after the fastener tape is knitted, the fastener stringer is made by sewing a continuous (for example, coil shaped) element row to the element attachment portion including the first and second wales.

Therefore, the fastener tape of Patent Document 3 is basically different from the fastener tapes of Patent Document 1 and Patent Document 2 which makes the fastener stringer by forming the synthetic resin or metallic fastener elements in the element attachment portion and swaging and fixing the metallic fastener elements.

The fastener tape of Patent Document 3 will be explained more specifically. The element attachment portion of the fastener tape is made of the first and second wales, and a chain knitting yarn and an inserted warp yarn are arranged in the first and second wales. Further, in the first wale, a tricot knitting yarn for forming a knitting structure by reciprocally going back and forth to an adjacent fastener tape is arranged, and in the second wale, a tricot knitting yarn for forming a knitting structure by reciprocally going back and forth to the third wale is arranged. On the other hand, a chain knitting yarn, an inserted warp yarn, and a tricot knitting yarn are arranged in each of the third and subsequent wales constituting the tape main body portion of the fastener tape.

In this fastener tape, an inserted weft yarn which is inserted in a zigzag manner between four wales is arranged. In particular, in Patent Document 3, the inserted weft yarn arranged between the first wale and the fourth wale is arranged to be thicker than the inserted weft yarn arranged in the other portions.

In the fastener tape of Patent Document 3 having the knitting structure as described above, the thick inserted weft yarn is arranged between the first wale and the fourth wale, and the tricot knitting yarn is arranged between the first wale and the wale of the adjacent fastener tape. Moreover, in the fastener tape, no tricot knitting yarn is arranged between the first wale and the second wale, and the second wale is configured to be movable to the side of the third wale.

Therefore, in the fastener tape, the interval between the first wale and the second wale is increased to an interval wider than the wale interval of the tape main body portion, and at the same time, the wales between the second wale and the fourth wale are closer than the fourth and subsequent wales.

As described above, the interval between the first wale and the second wale is increased, so that when continuous element rows are sewn and attached to the element attachment portion of the fastener tape using a sewing yarn, the sewing yarn can be stably accommodated within the interval between the first wale and the second wale, and the position of the sewn element row can be prevented from displacing in the width direction of the tape. Further, according to Patent Document 3, the wales between the second wale and the fourth wale are close to each other, so that even when the tape region from the second wale to the fourth wale slides on and comes into contact with the slider, the yarn is not worn off, and the abrasion resistance can be improved.

PRIOR ART DOCUMENT

Patent Document

Patent Document 1: Japanese Utility Model Application Publication No. 55-148409

Patent Document 2: Japanese Patent Application Laid-Open No. 8-56713

Patent Document 3: Japanese Examined Utility Model Application Publication No. 54-35767

SUMMARY OF THE INVENTION

Problems to be Solved by the Invention

The conventional fastener tapes as described in Patent Document 1 and Patent Document 2 having the warp knitting structure wherein the core thread is arranged in the element attachment portion has a drawback in that, for example, when the slide fastener is made by attaching the metallic fastener elements to the element attachment portion by swaging the metallic fastener elements to the element attachment portion and by forming the synthetic resin or metallic fastener element, the knitting yarn in the tape region arranged on the region on which the flange of the slider passes (hereinafter this tape region is abbreviated as a flange pass region) is likely to be cut by friction as described above, and there is only a low degree of abrasion resistance caused by sliding movement of the slider.

On the other hand, in the fastener tape of Patent Document 3, a predetermined knitting structure as described above is provided, so that the wales between the second wale and the fourth wale are set close to each other, and the abrasion resistance is improved in the tape region between the second wale and the fourth wale. However, in the fastener tape of Patent Document 3, no core thread is arranged in the element attachment portion. Therefore, with this fastener tape, the second and third wales are moved to the side of the fourth wale, and the wales between the second wale and the fourth wale can be set closer to each other, but the interval between the first wale and the second wale is expanded on the contrary.

When the knitting structure described in Patent Document 3 as described above is applied to, for example, the fastener tape in which the core thread is arranged in the element attachment portion such as Patent Document 1 and Patent Document 2, there is the following issue. When the interval between the first and second wales constituting the element attachment portion is expanded more than necessary, the core thread arranged between the first and second wales cannot be held firmly, and the position of the core thread becomes unstable.

As described above, when the position of the core thread is not stable, there is the following problem. When the fastener elements are attached to the element attachment portion so as to sandwich the core thread, the position and the posture of the fastener elements become unstable, and this may cause reduction of the engaging strength of the slide fastener and reduction of the sliding performance of the slider.

When the fastener tape of Patent Document 3 is made with the knitting structure as described above, the first wale and the fourth wale are held at predetermined positions, and the second and third wales are pulled to the side of the fourth wale by the tension of the inserted weft yarn, so that the wales between the second wale and the fourth wale are set close to each other.

However, even though the interval between the wales is reduced using the tension of the inserted weft yarn as described above, the size of the reduction is limited. Therefore, by only using the tension of the inserted weft yarn, the interval between the wales may not be sufficiently brought closer in order to improve the strength and the abrasion resistance of the fastener tape, depending on the purpose of the slide fastener.

Further, the fastener tape of the warp knitting structure generally has a lower yarn density than the woven structure fastener tape. Therefore, for example, when synthetic resin fastener elements are formed by means of injection molding or a metallic fastener elements are formed by means of die casting at the element attachment portion of the fastener tape of the warp knitting structure, resin leakage is likely to occur from the knitted loops of the element attachment portion sandwiched by an upper mold and a lower mold when the injection molding or the die casting is performed, and there is a problem in that this causes reduction of the quality of the slide fastener and reduction of yield.

For the problem of the resin leakage during the injection molding or the die casting of the fastener tape, for example, it may be possible to prevent leakage of a synthetic resin material or a metallic material from knitted loops of the fastener tape, by increasing the thickness of the fastener tape as well as increasing the closing of the formation mold.

However, in this case, when the mold is closed, the fastener tape is excessively damaged by the tightening force of the upper mold and the lower mold, and there is a problem in that this reduces the strength in the tape region tightened by the mold. Moreover, the tape region sandwiched by the upper mold and the lower mold is often arranged on a region on which the flange of the slider passes when the slide fastener is made, and there is a problem in that this also significantly reduces the abrasion resistance to the sliding movement of the slider.

The invention is made in view of the above conventional problems, and a specific object of the invention is to provide a fastener tape and a fastener stringer having fastener elements attached to the fastener tape, wherein while the flexibility of a tape main body portion is maintained, the tape strength and the abrasion resistance of a predetermined tape region are improved, and further, when the fastener elements are formed in an element attachment portion, occurrence of resin leakage from a knitted loop can be prevented.

Means for Solving the Problems

In order to achieve the above object, a fastener tape provided by the invention is a fastener tape for a slide fastener, and the fastener tape includes, as a basic configuration, a tape main body portion having a warp knitting structure and an element attachment portion knitted along one side edge of the tape main body portion, wherein a core thread is knitted into the element attachment portion at the same time. The fastener tape is most mainly characterized in that the tape main body portion includes a first tape main body portion region arranged at the side of the element attachment portion and having at least one row of wale and a second tape main body portion region arranged from a wale adjacent to the first tape main body portion region to other side edge of the tape main body portion, and a wale interval between a wale of the element attachment portion adjacent to the first tape main body portion region and a wale constituting the first tape main body portion region is narrower than a wale interval between wales constituting the second tape main body portion region.

In this case, a heat-shrinkable yarn having heat shrinking property is preferably arranged through two or more rows of wales in the wale of the element attachment portion adjacent to the first tape main body portion region and the wale constituting the first tape main body portion region, and a heat shrinking rate of the heat-shrinkable yarn is preferably set at a level higher than that of a yarn arranged through two or more rows of wales in a wale constituting the second tape main body portion region.

The fastener tape according to the invention preferably includes a first inserted weft yarn which is inserted through the wale of the element attachment portion adjacent to the first tape main body portion region and at least two or more rows of wales arranged in the first tape main body portion region at the side of the element attachment portion.

In this case, it is preferable to include a second inserted weft yarn which is inserted in a direction crossing the first inserted weft yarn between courses and is arranged through the wale of the element attachment portion adjacent to the first tape main body portion region and at least two or more rows of wales of the wales constituting the first tape main body portion region. Further, it is preferable to include an inserted warp yarn which is inserted into each wale constituting the first tape main body portion region.

The fastener tape according to the invention may include a first single cord knitting yarn which is inserted through the wale of the element attachment portion adjacent to the first tape main body portion region and at least three or more rows of wales of the wales constituting the first tape main body portion region and a second single cord knitting yarn which is inserted in a direction crossing the first single cord knitting yarn between courses and is arranged through the wale of the element attachment portion adjacent to the first tape main body portion region and at least three or more rows of wales of the wales constituting the first tape main body portion region.

In the fastener tape according to the invention, the wale of the element attachment portion adjacent to the first tape main body portion region and the wale constituting the first tape main body portion region is preferably arranged with a yarn line of which fineness is less than that of a constituent yarn line constituting the second tape main body portion region.

Further, in the invention, when the fastener tape is used to make a slide fastener, the first tape main body portion region preferably includes more wales than wales arranged on a region on which a flange of a slider constituting the slide fastener passes.

In addition, according to the invention, a fastener stringer can be provided, wherein fastener elements made of synthetic resin or metal is attached to the fastener tape having the above configuration.

Effect of the Invention

A fastener tape for a slide fastener according to the invention is made as a warp knitting structure, and a core thread is knitted into an element attachment portion at the same time as knitting of the fastener tape. The tape main body portion includes a first tape main body portion region arranged on a side edge portion at the side of the element attachment portion and a second tape main body portion region arranged from a wale adjacent to the first tape main body portion region to other side edge of the tape main body portion. Each wale interval between a wale of the element attachment portion adjacent to the first tape main body portion region and a wale constituting the first tape main body portion region is narrower than a wale interval of the second tape main body portion region.

With the fastener tape according to the invention as described above, the flexibility of the second tape main body portion region can be ensured in a stable manner, and the wale of the element attachment portion adjacent to the first tape main body portion region and the wale constituting the first tape main body portion region are brought closer to each other, and the yarn density is increased in the first tape main body portion region and the region of the element attachment portion at the side of the tape main body portion. Therefore, the tape strength and the abrasion resistance in the tape region can be easily improved.

Further, with the fastener tape according to the invention, the yarn density can be improved in the tape region described above, and therefore, for example, when synthetic resin fastener elements are formed by means of injection molding or metallic fastener elements are formed by means of die casting at the element attachment portion, resin leakage through the knitted loops of the element attachment portion can be prevented effectively, and the quality and yield of the slide fastener can be improved.

In particular, in the fastener tape of the invention, a heat-shrinkable yarn having heat shrinking property is arranged through two or more rows of wales in the wale of the element attachment portion adjacent to the first tape main body portion region and the wale constituting the first tape main body portion region, and a heat shrinking rate of the heat-shrinkable yarn is set at a level higher than that of a yarn arranged through two or more rows of wales in a wale constituting the second tape main body portion region. Accordingly, using the heat shrink of the heat-shrinkable yarn explained above, the wale interval in the wale of the element attachment portion adjacent to the first tape main body portion region and the wale constituting the first tape main body portion region can be narrowed reliably.

Therefore, in the fastener tape according to the invention, the interval between wales constituting the element attachment portion (i.e., the interval between the first and second wales) does not increase, in contrast to Patent Document 3 explained above, for example. Therefore, the core thread can be held at the predetermined position of the element attachment portion in a stable manner, and the position and the posture of the fastener elements attached to the element attachment portion can be stabilized.

The heat shrinking rates of yarns can be compared by, for example, checking heat histories of these yarns even after the yarns have shrunk by heat. More specifically, the heat stress of a yarn is checked. More specifically, the strain accumulated in the yarn is measured according to the temperature and the tension and the like applied to the yarn during the manufacturing steps, and the history of the temperature and the tension applied during the manufacturing steps can be estimated. The level of the heat shrinking rate of the yarn can be compared based on the history of the temperature and the tension thus estimated.

The fastener tape according to the invention as described above includes, as one of the constituent yarn lines, a first inserted weft yarn which is inserted through the wale of the element attachment portion adjacent to the first tape main body portion region and at least two or more rows of wales arranged in the first tape main body portion region at the side of the element attachment portion. Since the first inserted weft yarn described above is provided as the heat-shrinkable yarn, the wale interval between the wale of the element attachment portion adjacent to the first tape main body portion region and two rows of wales arranged in the first tape main body portion region at the side of the element attachment portion can be narrowed reliably.

In this case, in addition to the first inserted weft yarn, the fastener tape includes, as one of the constituent yarn lines of the fastener tape, a second inserted weft yarn which is inserted in a direction crossing the first inserted weft yarn between courses and is arranged through the wale of the element attachment portion adjacent to the first tape main body portion region and at least two or more rows of wales of the wales constituting the first tape main body portion region, wherein the second inserted weft yarn is the heat-shrinkable yarn.

Therefore, the wale interval in the tape region in which the first and second inserted weft yarns are arranged can be narrowed more reliably. The tape region arranged with the wale of the element attachment portion adjacent to the first tape main body portion region and the wale constituting the first tape main body portion region is caused to shrink in the tape length direction, and the yarn density in the tape region can be further increased.

The fastener tape further includes, as one of the constituent yarn lines of the fastener tape, an inserted warp yarn which is inserted into each wale constituting the first tape main body portion region, so that the yarn density of the first tape main body portion region can be further increased, and the tape strength and the abrasion resistance in the region can be further improved.

In the invention, as one of the constituent yarn lines of the fastener tape, the fastener tape may include, in addition to the first inserted weft yarn, the first and second single cord knitting yarns which is inserted through the wale of the element attachment portion adjacent to the first tape main body portion region and at least three or more rows of wales of the wales constituting the first tape main body portion region.

Because the first and second single cord knitting yarns as described above are arranged, the wale interval can be narrowed reliably, and the tape region in which the first inserted weft yarn and the first and second single cord knitting yarns are arranged is caused to shrink in the tape length direction, so that the yarn density of the tape region can be further increased.

Further, in the fastener tape according to the invention, the wale of the element attachment portion adjacent to the first tape main body portion region and the wale constituting the first tape main body portion region is arranged with a yarn line of which fineness is less than that of a constituent yarn line constituting the second tape main body portion region (yarn line of which thickness is thin). Therefore, the knitting structure of the tape region arranged with the wale of the element attachment portion adjacent to the first tape main body portion region of the element attachment portion and the wale constituting the first tape main body portion region can be formed more densely.

Therefore, the tape strength and the abrasion resistance can be improved without increasing the tape thickness in the tape region. Accordingly, when the fastener elements are formed at the element attachment portion by means of the injection molding or the die casting, the damage which the tape region receives due to the tightening of the mold can be prevented, and the resin leakage through the knitted loops of the element attachment portion can be prevented more reliably.

Still further, in the fastener tape according to the invention, when the fastener tape is used to make a slide fastener, the first tape main body portion region includes more wales than wales arranged on a region (line) on which a flange of a slider constituting the slide fastener passes.

For example, when the second to fourth wales arranged on the region on which the flange of the slider passes are close to each other as described in Patent Document 3 explained above, the tape strength and the abrasion resistance in the tape region arranged with the second to fourth wale (flange pass region) can be improved. However, the wale interval between the fourth wale and the fifth wale is wider than the wale interval of the second to fourth wales. Therefore, when the slide fastener is used for a long period of time, and the slider is repeatedly slid, the fourth wale gradually moves to the fifth wale due to the friction and the like caused by sliding movement of the slider, and the abrasion resistance in the flange pass region may be reduced over time.

In contrast, when the first tape main body portion region is made with more wales than the wales arranged on the region on which the flange of the slider passes like the invention, the tape region in which the wales are arranged close to each other can be formed more widely than the flange pass region.

Therefore, even when the slide fastener is used for a long period of time, and the slider is repeatedly slid, the wale of the first tape main body portion region adjacent to the second tape main body portion region is less likely to be affected by the sliding movement of the slider, and even when the slide fastener is used for a long period of time, it is possible to prevent the wale from moving to the side of the second tape main body portion region. Even when the wale adjacent to the second tape main body portion region moves to the side of the second tape main body portion region, the wale does not constitute the flange pass region, and therefore, the abrasion resistance against the sliding movement of the slider is not reduced over time.

Further, the first tape main body portion region having the dense knitting structure is formed widely in the tape width direction, so that while the flexibility of the second tape main body portion region is ensured, the knitting structure of the element attachment portion can be held stably with the element attachment portion and the second tape main body portion region being spaced apart. Therefore, the fastener elements can be fixed firmly to the element attachment portion in a stable manner, and when the fastener tape is used to make the slide fastener, the position and the posture of the fastener elements with respect to the fastener tape are stable. Therefore, the right and left fastener elements can be engaged smoothly.

Further, a fastener stringer provided by the invention is manufactured by attaching synthetic resin or metallic fastener elements to the fastener tape having the above configuration. In the fastener stringer according to the invention as described above, the second tape main body portion region of the fastener tape has appropriate flexibility, and the yarn density of the tape region formed by the wale of the element attachment portion adjacent to the first tape main body portion region and the wale constituting the first tape main body portion region is enhanced. Therefore, the tape strength of the tape region is high, and when the fastener stringer is used to make the fastener stringer, the abrasion resistance of the fastener tape against the sliding movement of the slider can be greatly improved.

Further, when the fastener stringer according to the invention is manufactured by, for example, forming fastener elements made of synthetic resin on the fastener tape by means of the injection molding or by forming metallic fastener elements by means of the die casting on the fastener tape, resin/metal leakage does not occur (or less likely to occur) through the knitted loops of the element attachment portion during the injection molding or the die casting. Therefore, the fastener stringer is made into a high quality fastener stringer to which a fastener element of the predetermined shapes are attached to the element attachment portion in a stable manner.

MODE FOR CARRYING OUT THE INVENTION

Hereinafter, modes of the invention will be explained in detail with reference to drawings using embodiments. It should be noted that the invention is not at all limited to each embodiment explained below, and as long as substantially the same configuration as the invention and the same actions and effects are obtained, various changes are possible.

For example, in the embodiments below, a case where a fastener stringer made by forming synthetic resin fastener elements at an element attachment portion of a knitted fastener tape by means of injection molding is explained. However, the invention is not limited thereto. Alternatively, for example, a fastener stringer can be made by forming metallic fastener elements by means of die casting or by swaging and attaching metallic fastener elements (also referred to as element device) formed into a predetermined shape, at the element attachment portion of the fastener tape according to the invention. In addition, it is possible to change, as necessary, the material and the fineness of yarns used for the fastener tape, the thickness of the fastener tape, a heat shrinking rate of a yarn having a heat shrinking property, and the like.

First Embodiment

Figure 1:
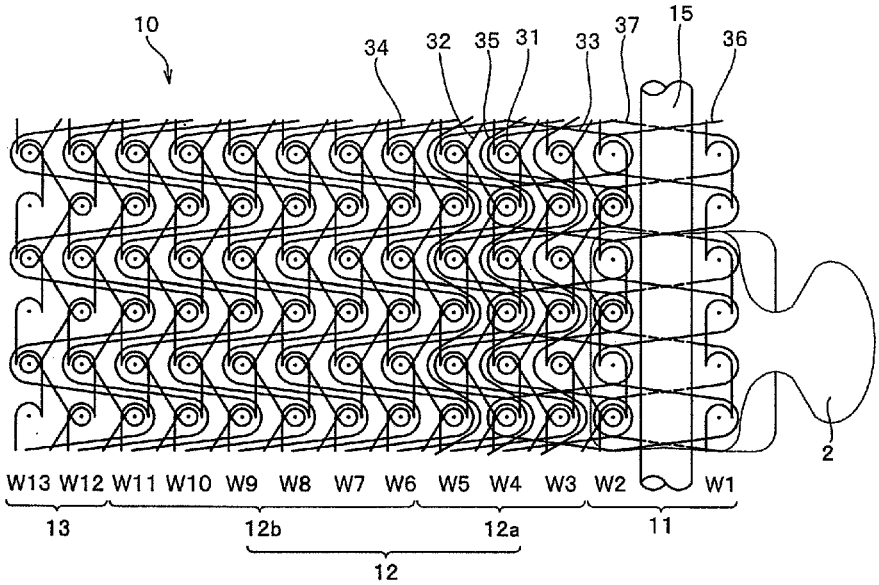
FIG. 1 is a structure diagram illustrating a warp knitting structure of a fastener tape according to a first embodiment of the invention.
Figure 2:
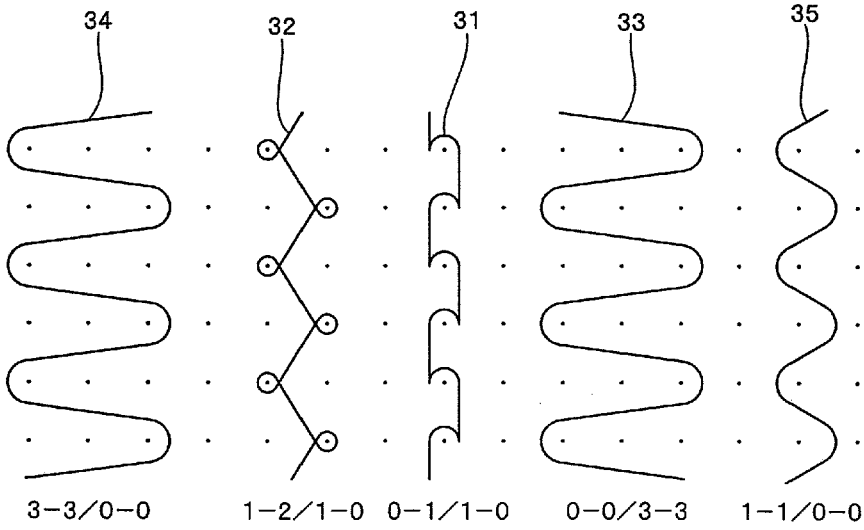
FIG. 2 is a knitting structure diagram illustrating each constituent yarn used in the fastener tape.
Figure 3:
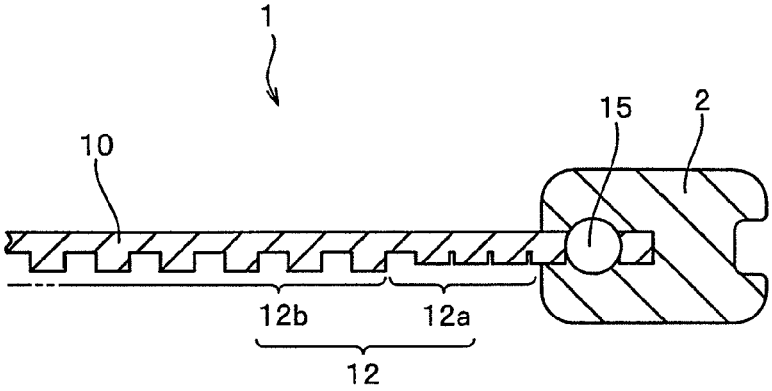
FIG. 3 is a cross sectional view illustrating a fastener stringer made by forming synthetic resin fastener elements at an element attachment portion of the fastener tape by means of injection molding.

FIG. 1 is a structure diagram illustrating a warp knitting structure of a fastener tape according to the first embodiment. FIG. 2 is a knitting structure diagram illustrating each constituent yarn used in the fastener tape. FIG. 3 is a cross sectional view illustrating a fastener stringer made by forming synthetic resin fastener elements at an element attachment portion of the fastener tape by means of injection molding.

In the explanation below, the longitudinal direction of the fastener tape 10 is defined as a course direction, and each wale explained later extends in the course direction. On the plane of the fastener tape 10, a direction perpendicular to the longitudinal direction is defined as a width direction of the fastener tape. Further, the front/back direction of the fastener tape is defined as a thickness direction.

The fastener tape 10 according to this first embodiment is a belt-like body having a thin width, the entirety of which is made of a single warp-knitted structure. The entire tape widths are made of a first wale W 1 to a thirteenth wale W 13. The fastener tape 10 includes a tape main body portion 12, an element attachment portion 11 arranged along one side edge of the tape main body portion 12, and an ear portion 13 arranged along the other side edge of the tape main body portion 12. A core thread 15 is knitted into the element attachment portion 11.

The element attachment portion 11 is a portion for attaching the fastener element, and is a portion including two wales, i.e., the first wale W1 and the second wale W2 located to sandwich the core thread 15.

In this case, one side edge of the tape main body portion 12 is the third wale W3 in FIG. 1, and is located adjacent to the second wale W2 of the element attachment portion 11. On the other hand, the other side edge of the tape main body portion 12 is the eleventh wale W11 in FIG. 1, and is located adjacent to the twelfth wale W12 of the ear portion 13.

In this fastener tape 10, the wale arranged at the side of one side edge of the tape of the fastener tape 10 is the first wale W1, the element attachment portion 11 is constituted by the first wale W1 and the second wale W2, the tape main body portion 12 is constituted by the third wale W3 to eleventh wale W11, and the ear portion 13 is constituted by the twelfth wale W12 and the thirteenth wale W13.

In particular, in the first embodiment, the tape main body portion 12 is constituted by the third wale W3 to fifth wale W5 at the side edge portion at the side of the element attachment portion 11, and the tape main body portion 12 includes a first tape main body portion region 12*a* arranged with a heat shrinking yarn having a heat shrinking property explained later and a second tape main body portion region 12*b* constituted by the sixth wale W6 to eleventh wale W11.

In the invention, the number of wales in the element attachment portion 11, the tape main body portion 12, and the ear portion 13 can be set at any number in accordance with the size of the slide fastener and the size of the fastener element, and the like. Further, at least a portion of the fastener tape 10 can be knitted in a double structure.

The fastener tape 10 according to the first embodiment is knitted to have a knitting structure as illustrated in FIGS. 2 and 3.

More specifically, the knitting structure of the tape main body portion 12 includes a chain knitting yarn 31 (0-1/1-0) arranged in each wale, a tricot knitting yarn 32 (1-2/1-0), a first inserted weft yarn 33 (0-0/3-3) inserted in a zigzag manner between three wales, i.e., the second wale W2 to fourth wale W4, a second inserted weft yarn 34 (3-3/0-0) inserted in a zigzag manner between the three wales in a direction crossing the first inserted weft yarn 33 between courses, and an inserted warp yarn 35 (1-1/0-0) inserted in a zigzag manner along each of the third wale W3 to fifth wale W5.

In this case, "between courses" means "between knitted loops formed by a needle". "The first inserted weft yarn 33 and the second inserted weft yarn 34 crossing between courses" means that the first inserted weft yarn 33 and the second inserted weft yarn 34 are inserted with one displacement in the course direction, which more rigidly connects the second wale W2 and the third wale W3.

In this case, the second inserted weft yarn 34 is arranged over the entirety of the second wale W2 to the thirteenth wale W13. In the invention, in addition to the knitting structure of the tape main body portion 12 according to the first embodiment, the first inserted weft yarn 33 may be further inserted between three wales, i.e., the third wale W3 to the fifth wale W5.

Among the constituent yarn lines constituting the tape main body portion 12 explained above, heat shrinking yarns having a heat shrinking property are used in the following yarns: the first inserted weft yarn 33, the second inserted weft yarn 34 inserted between the second wale W2 and the fourth wale W4, the second inserted weft yarn 34 inserted between the third wale W3 and the fifth wale W5, and the inserted warp yarn 35 arranged in each of the third wale W3 to the fifth wale W5. In this case, the dry heat shrinking rate of the yarn having heat shrinking property is set at a rate equal to or more than 10% and equal to or less than 15%.

Among the constituent yarn lines constituting the tape main body portion 12, the first inserted weft yarn 33 explained above, the predetermined two second inserted weft yarns 34, and yarn lines other than the inserted warp yarn 35 (for example, the tricot knitting yarn 32, the second inserted weft yarn 34 inserted into the sixth and subsequent wales W6, and the like) have a heat shrinking property which is less than the dry heat shrinking rate of the first inserted weft yarn 33 explained above, the predetermined two second inserted weft yarns 34, and the inserted warp yarn 35. In this case, the dry heat shrinking rate of the yarns having the small heat shrinking property is set at, for example, a rate equal to or more than 5% and equal to or less than 8%.

More specifically, in the first embodiment, the heat shrinking property of the second inserted weft yarns 34 arranged between the second wale W2 and the thirteenth wale W13 other than two second inserted weft yarns 34, i.e., the second inserted weft yarn 34 inserted between the second wale W2 and the fourth wale W4 and the second inserted weft yarn 34 inserted between the third wale W3 and the fifth wale W5, is less than the heat shrinking property of the second inserted weft yarn 34 inserted between the second wale W2 and the fourth wale W4 and the second inserted weft yarn 34 inserted between the third wale W3 and the fifth wale W5.

In the invention, the yarn line having heat shrinking property may be used for yarn lines such as the tricot knitting yarn 32 and the second inserted weft yarn 34 other than the first inserted weft yarn 33, the predetermined two second inserted weft yarns 34, and the inserted warp yarn 35. In this case, the dry heat shrinking rate of the yarn lines such as the tricot knitting yarn 32 is set at a rate less than the dry heat shrinking rate of the first inserted weft yarn 33 explained above, the predetermined two second inserted weft yarns 34, and the inserted warp yarn 35.

On the other hand, the knitting structure of the element attachment portion 11 includes a chain knitting yarn 31 (0-1/1-0) arranged in each of the first and second wales W1, W2, a pair of a third inserted weft yarn 36 (2-2/0-0) and a fourth inserted weft yarn 37 (0-0/2-2) arranged between the first and second wales W1, W2, the tricot knitting yarn 32 (1-2/1-0) explained above arranged between the second and third wales W2, W3, and the first inserted weft yarn 33 (3-3/0-0) and the second inserted weft yarn 34 (0-0/3-3) explained above inserted in a zigzag manner between three wales, i.e., the second wale W2 to the fourth wale W4.

In this case, the third inserted weft yarn 36 and the fourth inserted weft yarn 37 are inserted such that their insertion positions are displaced from each other by one course in the course direction so that the third inserted weft yarn 36 and the fourth inserted weft yarn 37 cross between the courses. The third inserted weft yarn 36 is arranged at the front surface side of the tape with respect to the core thread 15, and the fourth inserted weft yarn 37 is arranged at the back surface side of the tape with respect to the core thread 15. Accordingly, the core thread 15 is held by being sandwiched between the front and back surfaces by the third and fourth inserted weft yarns 36, 37.

The first and second inserted weft yarns 33, 34 inserted between the second wale W2 and the fourth wale W4 have the heat shrinking property explained above. It should be noted that the yarn line having heat shrinking property can also be used for not only the first and second inserted weft yarns 33, 34 but also constituent yarn lines constituting the element attachment portion 11. In this case, the dry heat shrinking rate is set at a rate smaller than the dry heat shrinking rate of the first and second inserted weft yarns 33, 34 explained above.

Further, the core thread 15 arranged between the first wale W1 and the second wale W2 of the element attachment portion 11 is knitted into the element attachment portion 11 at the same time the fastener tape 10 is knitted. This core thread 15 is held by being inserted between the chain knitting yarns 31 arranged in the first and second wales W1, W2 and the third inserted weft yarn 36 and the fourth inserted weft yarn 37 arranged between the first and second wales W1, W2.

The knitting structure of the ear portion 13 according to the first embodiment is made using the chain knitting yarn 31 (0-1/1-0) arranged in each of the twelfth and thirteenth wales W12, W13 and the tricot knitting yarn 32 (1-2/1-0) and the second inserted weft yarn 34 (0-0/3-3) explained above which are also arranged in the tape main body portion 12.

In the fastener tape 10 according to the first embodiment having such knitting structure, nylon or polyester multifilament yarns are used for constituent yarn lines arranged in the ear portion 13 (the twelfth and thirteenth wales W12, W13) other than the chain knitting yarn 31. In this case, yarn lines of the chain knitting yarn 31, the tricot knitting yarn 32, the first inserted weft yarn 33, the second inserted weft yarn 34, and the inserted warp yarn 35 arranged in the second wale W2 to the fifth wale W5 (including yarn lines at least a portion of which is inserted through at least one row of wale of the second wale W2 to the fifth wale W5) use thin yarn lines of which fineness is smaller than the constituent yarn line constituting the second tape main body portion region 12*b* (more specifically, the chain knitting yarn 31, the tricot knitting yarn 32, and the second inserted weft yarn 34 arranged only in the sixth wale W6 to the eleventh wale W11 (except yarn lines between the fourth and fifth wales W4, W5)). The magnitude of the fineness can be compared by measuring the weights of yarns in a unit length. In this case, the lighter the weight is, the smaller the fineness is. It should be noted that the fineness is represented using a unit of deci-tex (dtex).

Therefore, while the flexibility of the second tape main body portion region 12*b* is ensured, the tape region including the second wale W2 adjacent to the first tape main body portion region 12*a* of the element attachment portion 11 and the third wale W3 to the fifth wale W5 constituting the first tape main body portion region 12*a* can be formed with a dense knitting structure without increasing the tape thickness.

In this case, a multifilament yarn having a fineness equal to or more than 56 deci-tex (dtex) and equal to or less than 300 deci-tex (dtex) is preferably used for the chain knitting yarn 31, the tricot knitting yarn 32, the first inserted weft yarn 33, the second inserted weft yarn 34, and the inserted warp yarn 35 arranged as thin yarn lines in the second wale W2 to the fifth wale W5. A multifilament yarn having a fineness equal to or more than 200 deci-tex (dtex) and equal to or less than 500 deci-tex (dtex) is preferably used for the chain knitting yarn 31, the tricot knitting yarn 32, and the second inserted weft yarn 34 arranged only in the second tape main body portion region 12*b*.

Further, in the fastener tape 10 according to the first embodiment, a composite yarn having core-sheath structure: used for the chain knitting yarn 31 arranged in the ear portion 13 (the twelfth and thirteenth wales W12, W13). A polyvinyl alcohol water-soluble synthetic resin is used in a sheath portion of this composite yarn, and a nylon or polyester resin, i.e., fiber material used for the tape main body portion 12, is used for the core portion.

When such composite yarn is immersed in hot water, the water-soluble synthetic resin constituting the sheath portion is dissolved in water, and ultimately, only a nylon or polyester thin yarn constituting the core portion remains. Therefore, the ear portion 13 in which the chain knitting yarn 31 is arranged can be formed more flexibly. In the invention, not only the composite yarn can be used as the chain knitting yarn 31 of the water-soluble yarn arranged in the ear portion 13, but also a paralleled knitting yarn including, for example, a single yarn line made of water-soluble resin fiber and a single yarn line made of an ordinary synthetic fiber can be used as the chain knitting yarn 31 of the water-soluble yarn arranged in the ear portion 13. It is also possible to use the chain knitting yarn 31 arranged in the first wale W1 as a single yarn line made of a water-soluble synthetic resin.

In the fastener tape 10 according to the first embodiment having such knitting structure, after knitting process is performed while the core thread 15 is knitted into the element attachment portion 11, heat treatment is applied, so that great heat shrinkage occurs in the yarn lines of the first inserted weft yarn 33, the second inserted weft yarn 34, and the inserted warp yarn 35 having the heat shrinking property which are arranged in the second wale W2 to the fifth wale W5.

In this case, in the heat treatment, processing is performed with dry heat in which the knitted fastener tape is thereafter heated with a heater. When the fastener tape is dyed, the heat is also applied to the fastener tape, and this heat causes shrinkage. In this case, heating in atmosphere is defined as dry heat, and the shrinking rate with the dry heat is defined as the dry heat shrinking rate.

The second inserted weft yarn 34 passing between the first tape main body portion region 12*a* and the second tape main body portion region 12*b* has a heat shrinking property which is less than that of the second inserted weft yarn 34 arranged in the second wale W2 to the fifth wale W5. Therefore, the interval between the fifth wale W5 and the sixth wale W6 is wider than the interval of the wales adjacent to each other in the second wale W2 to fifth wale W5.

The fifth wale W5 and the sixth wale W6 are connected by knitting yarns passing through both of the first tape main body portion region 12*a* and the second tape main body portion region 12*b*. Likewise, connection is made with knitting yarns passing through both of the second wale W2 of the element attachment portion 11 and the third wale W3 of the first tape main body portion region 12*a*, and connection is made with knitting yarns passing through both of the eleventh wale W11 of the second tape main body portion region 12*b* and the twelfth wale W12 of the ear portion 13.

Accordingly, the second wale W2 to the fifth wale W5 are pulled in a direction to move closer to each other, so that the interval between each of the second wale W2 to the fifth wale W5 is narrowed, and the second wale W2 to the fifth wale W5 are closer to each other than the sixth wale W6 to the eleventh wale W11 constituting the second tape main body portion region 12*b*. At the same time, the interval between courses is narrowed in the tape region ranging from the second wale W2 to the fifth wale W5, and therefore, the size of the tape region in the tape length direction becomes shorter than the second tape main body portion region 12*b*.

Therefore, in the fastener tape 10 having been subjected to the heat treatment, the second tape main body portion region 12*b* including the sixth wale W6 to the eleventh wale W11 and the ear portion 13 including the twelfth and the thirteenth wales W12, W13 have appropriate flexibility, and at the same time, the tape region ranging from the second wale W2 to the fifth wale W5 has a high yarn density and formed densely, so that the tape strength of the tape region is improved. Further, when the slide fastener is made using the fastener tape 10, the tape region ranging from the second wale W2 to the fifth wale W5 is dense, and therefore, the abrasion resistance to the sliding movement of the slider 4 can be improved as explained later (see FIG. 4).

In particular, as described above, yarn lines of which fineness is less than that of the constituent yarn lines constituting the second tape main body portion region 12*b* are used for the second wale W2 to the fifth wale W5 according to the first embodiment, and therefore, the tape region ranging from the second wale W2 to the fifth wale W5 has an extremely dense knitting structure, and the tape strength of the tape region can be further improved effectively.

Moreover, in the fastener tape 10 according to the first embodiment, the tape region having a high yarn density and formed with a dense knitting structure is widely formed from the second wale W2 to the fifth wale W5. Therefore, even when the second tape main body portion region 12*b* is flexibly formed, the element attachment portion 11 and the second tape main body portion region 12*b* are spaced apart from each other with the first tape main body portion region 12*a* interposed therebetween, and the knitting structure of the element attachment portion 11 can be stabilized. Therefore, when fastener elements 2 are attached to the fastener tape 10 as described later, the fastener elements 2 can be fixed to the element attachment portion 11 in a stable manner.

In the fastener tape 10 according to the first embodiment, the core thread 15 and the first inserted weft yarn 33, the second inserted weft yarn 34, and the inserted warp yarn 35 arranged in the second wale W2 to the fifth wale W5 are shrink by heat with the above heat treatment. Therefore, after the heat treatment, the form of the fastener tape 10 is as follows. The fastener tape 10 at the side of the element attachment portion 11 shrinks, in the tape length direction, than at the side edge portion at the side of the tape which is opposite side thereto (at the side of the ear portion 13), and the entire fastener tape 10 is bent in an arc shape.

With the fastener tape 10 according to the first embodiment as described above, the fastener elements 2 are attached to the element attachment portion 11, so that the fastener stringer 1 can be constituted.

In the first embodiment, for example, a thermoplastic resin material such as polyacetal, polypropylene, polybutylene terephthalate, and nylon is formed at the element attachment portion 11 of the fastener tape 10 by means of injection molding, whereby the fastener elements 2 are formed, so that the fastener stringer 1 as illustrated in FIG. 3 is manufactured.

As described above, the fastener elements 2 made of synthetic resin are formed in the fastener tape 10 according to the first embodiment by means of injection molding, the first tape main body portion region 12*a* and the element attachment portion 11 of the fastener tape 10 is sandwiched between an upper mold and a lower mold for injection molding while a predetermined tension is applied in the tape length direction of the fastener tape 10. Then, molten resin is injected, with a high pressure, into the cavity of the mold for the injection molding which sandwich the fastener tape 10, and multiple fastener elements 2 of predetermined shapes are formed at the element attachment portion 11 of the fastener tape 10.

At this occasion, in the fastener tape 10 according to the first embodiment, the yarn density in the tape region ranging from the second wale W2 to the fifth wale W5 is high, and the knitting structure of the tape region is formed densely. Therefore, even though the molten resin is injected, with a high pressure, into the cavity of the mold while the fastener tape 10 is sandwiched between the upper mold and the lower mold, it is possible to effectively prevent leakage of the molten resin to the outside of the cavity through the gaps between the wales and the knitted loops of the fastener tape 10 (resin leakage).

Therefore, the fastener elements 2 can be formed into a predetermined shape in a stable manner. Moreover, leakage of the molten resin to the tape main body portion 12 of the fastener tape 10 can also be prevented, and therefore, when the synthetic resin is cooled, the tape main body portion 12 does not become rigid.

The thin yarn lines are arranged in the tape region ranging from the second wale W2 to the fifth wale W5, and therefore, the tape thickness of the tape region can be reduced as compared with that in the second tape main body portion region 12*b*. For this reason, even when the tape region ranging from the second wale W2 to the fifth wale W5 of the fastener tape 10 is sandwiched between the molds for the injection molding, the damage which the tape region receives from the pressure of the molds can be minimized, and it is possible to prevent from reducing the tape strength of the fastener tape.

Further, as described above, when the fastener stringer 1 is manufactured by forming the fastener elements 2 made of synthetic resin by means of the injection molding, the entire fastener tape 10 to which the fastener elements 2 are attached is bent in an arch shape as described above. As a result, when the slide fastener made using the obtained fastener stringer 1 is sewed and fixed to clothes, i.e., fastener-attached product, and the like, this can prevent waving creases from being formed on the fastener tape 10 and the clothes.

Figure 4:
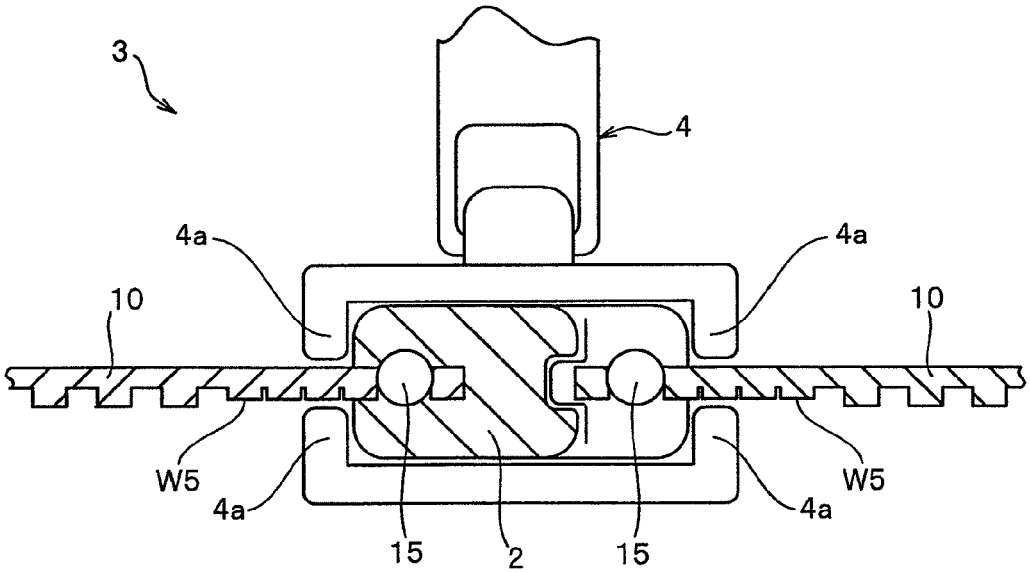
FIG. 4 is a cross sectional view illustrating a slide fastener made using the fastener stringer.

Two fastener stringers 1 manufactured as described above are made into a pair, and a slider 4 is slideably attached along the element rows of the fastener stringers 1, so that a slide fastener 3 as illustrated in FIG. 4 is manufactured. In the slide fastener 3 obtained as described above, the tapestrength of the tape region constituted by the second wale W2 to the fifth wale W5 is enhanced as described above.

For example, in general, when the slide fastener receives sideway pulling force with which the right and left fastener tapes are pulled in a direction away from each other, the element attachment portion of the fastener tape to which the fastener elements are attached and the first tape main body portion region of the fastener tape arranged between the element attachment portion and the second tape main body portion region sewn to the fastener-attached product such as clothes may greatly affected by the sideway pulling force.

In such case, in the slide fastener 3 according to the first embodiment, the tape strength of the first tape main body portion region 12*a* constituted by the third wale W3 to the fifth wale W5 is enhanced, and therefore, even when the slide fastener 3 receives the sideway pulling force, the slide fastener 3 according to the first embodiment can effectively prevent the problem that a constituent yarn line constituting the first tape main body portion region 12*a* is cut or becomes loose.

Further, in the fastener tape 10 of the slide fastener 3, the flange pass region arranged on a region on which the flange 4*a* of the slider 4 is inserted (in the first embodiment, the tape region constituted by the second wale W2 to the fourth wale W4) is included within the tape region ranging from the second wale W2 to the fifth wale W5 formed densely with a high yarn density as illustrated in FIG. 4.

As described above, the flange pass region of the fastener tape 10 is formed densely with a high yarn density, so that even if the slider 4 is repeatedly slid, a constituent yarn line of the flange pass region is less likely to be cut or become loose because of the friction between the fastener tape 10 and the flange 4*a* of the slider 4.

Further, in the fastener tape 10 according to the first embodiment, the tape region formed densely with the high yarn density is arranged from the second wale W2 to the fifth wale W5 which is wider than the flange pass region. In other words, in the example as illustrated in FIG. 4, the flange 4*a* of the slider 4 passes on the third wale W3 and the fourth wale W4. Therefore, in the first embodiment, the tape region formed densely with a narrow wale interval is from the second wale W2 up to the fifth wale W5 of the first tape main body portion region 12*a*.

Therefore, even when the slide fastener 3 is used for a long period of time, and the slider 4 is repeatedly slid, the fifth wale W5 is less likely to be affected by the sliding of the slider 4, and the fifth wale W5 does not move closer to the side of the sixth wale W6. Therefore, with the fastener tape 10 according to the first embodiment, the abrasion resistance to the sliding of the slider 4 does not decrease in proportion to the period in which the slide fastener 3 is used, and the slide fastener 3 can be used stably for a long period of time.

In the first embodiment, the fastener elements 2 are formed by forming the synthetic resin material at the element attachment portion 11 of the fastener tape 10 by means of the injection molding, whereby the fastener stringer 1 is made. However, with the fastener tape 10 according to the first embodiment, the fastener stringer can also be made by forming the fastener elements by forming the metallic materials at the element attachment portion 11 of the fastener tape 10 by means of die casting or by swaging and attaching the metallic fastener elements to the element attachment portion 11.

For example, when the fastener stringer 1 is made in which the metallic fastener elements 2 are fixed to the element attachment portion 11 by forming the metallic material on the fastener tape 10 by means of the die casting, this prevents molten metal from leaking through the gaps between the wales and the knitted loops of the fastener tape 10 (resin leakage), and prevents the molten metal from leaking to the tape main body portion 12 and making the tape main body portion 12 rigid, like the fastener elements 2 formed by forming the synthetic resin material by means of the injection molding.

Further, no matter whether the fastener stringer is made by forming the metallic material by means of the die casting or the fastener stringer is made by swaging the metallic fastener element, the entire fastener tape 10 of the fastener stringer having the fastener elements attached to the element attachment portion 11 can have a bent form in an arc shape, like the above case.

Two fastener stringers manufactured by forming the metallic material by means of the injection molding or swaging the metallic fastener elements 2 are made into a pair, whereby the slide fastener is made. Therefore, a slide fastener having a high degree of tape strength against the sideway pulling force and a high degree of abrasion resistance against the sliding movement of the slider 4 can be obtained.

Second Embodiment

Figure 5:
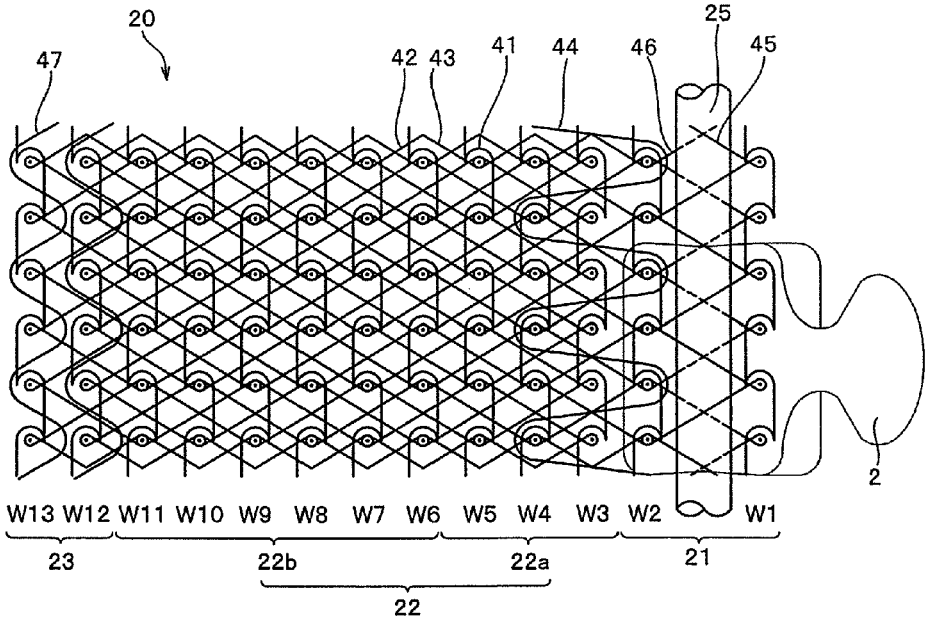
FIG. 5 is a structure diagram illustrating a warp knitting structure of a fastener tape according to a second embodiment of the invention.
Figure 6:
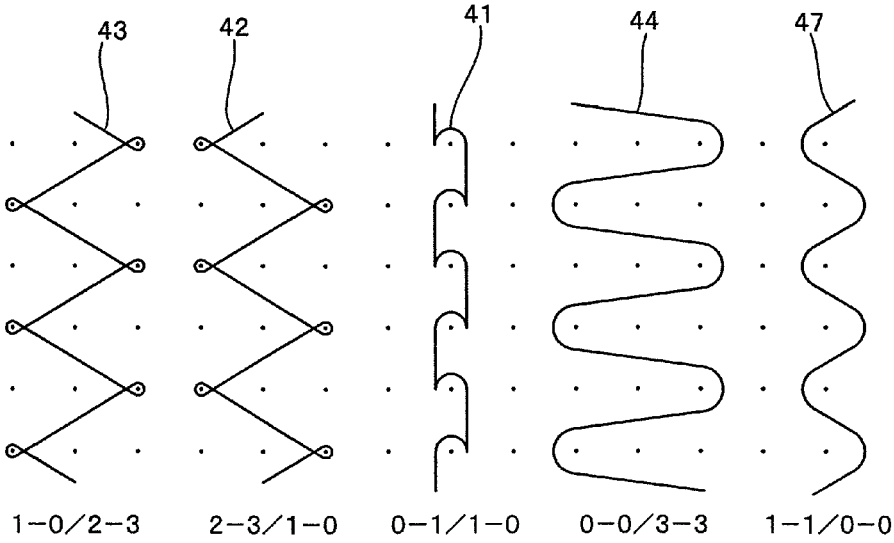
FIG. 6 is a knitting structure diagram illustrating each constituent yarn used in the fastener tape.

FIG. 5 is a structure diagram illustrating a warp knitting structure of a fastener tape according to a second embodiment. FIG. 6 is a knitting structure diagram illustrating each constituent yarn used in the fastener tape.

Like the above first embodiment, the fastener tape 20 according to the second embodiment is a belt-like body, the entirety of which is made of a single warp-knitted structure, wherein the entire tape width is made by the first wale W1 to the thirteenth wale W13. The fastener tape 20 includes an element attachment portion 21 made of first and second wales W1, W2, a tape main body portion 22 made of a third wale W3 to an eleventh wale W11, and an ear portion 23 made of twelfth and thirteenth wales W12, W13, and a core thread 25 is arranged between the first wale W1 and the second wale W2 of the element attachment portion 21.

In the second embodiment, the tape main body portion 22 includes a first tape main body portion region 22*a* arranged with a yarn line having heat shrinking property and located at a side edge portion at the side of the element attachment portion 21 and a second tape main body portion region 22*b* arranged with a yarn line having a heat shrinking property lower than that of the first tape main body portion region 22*a* or a yarn line not representing any heat shrinking property. In this case, the first tape main body portion region 22*a* is made of the third wale W3 to the fifth wale W5, and the second tape main body portion region 22*b* is made of the sixth wale W6 to the eleventh wale W11.

The knitting structure of the tape main body portion 22 according to the second embodiment includes a chain knitting yarn 41 (0-1/1-0) arranged in each wale, a first single cord knitting yarn 42 (2-3/1-0) inserted between three wales while forming needle loops as closed loops, a second single cord knitting yarn 43 (1-0/2-3) inserted between three wales while forming needle loops as closed loops and crossing the first single cord knitting yarn 42 between courses, and a first inserted weft yarn 44 (0-0/3-3) inserted in a zigzag manner between three wales, i.e., the second wale W2 to fourth wale W4. In this case, "between courses" means "between knitted loops formed by a needle". The first single cord knitting yarn 42 and the second single cord knitting yarn 43 are inserted with one displacement in the course direction, so that the first single cord knitting yarn 42 and the second single cord knitting yarn 43 cross each other between courses.

In this case, the first and second single cord knitting yarns 42, 43 are arranged over the entirety of the second wale W2 to the thirteenth wale W13. The same inserted warp yarn 47 (1-1/0-0) as that of the first embodiment may be further inserted into the third wale W3 to the fifth wale W5 in the tape main body portion 22 according to the second embodiment.

A yarn line of heat shrinking property having a dry heat shrinking rate equal to or more than 10% and equal to or less than 15% is used for the first inserted weft yarn 44 and first and second single cord knitting yarns 42, 43 inserted between three wales of the second wale W2 to the fifth wale W5 of the above constituent yarn lines constituting the tape main body portion 22. A yarn line having a dry heat shrinking rate which is less than 10% and which is less than the dry heat shrinking rate of the first and second single cord knitting yarns 42, 43 inserted into the second wale W2 to fifth wale W5 is used for constituent yarn lines other than the first inserted weft yarn 44 and the above predetermined single cord knitting yarns 42, 43 in the fastener tape 20.

At this step, in heat treatment, processing is performed with dry heat in which the knitted fastener tape is thereafter heated with a heater. When the fastener tape is dyed, the heat is also applied to the fastener tape, and this heat causes shrinkage. In this case, heating in atmosphere is defined as dry heat, and the shrinking rate with the dry heat is defined as the dry heat shrinking rate.

The first and second single cord knitting yarns 42, 43 passing between the first tape main body portion region 22*a* and the second tape main body portion region 22*b* have a heat shrinking property which is less than that of the second inserted weft yarn 34 arranged in the second wale W2 to the fifth wale W5. Therefore, the interval between the fifth wale W5 and the sixth wale W6 is wider than the interval of the wales adjacent to each other in the second wale W2 to fifth wale W5.

The fifth wale W5 and the sixth wale W6 are connected by knitting yarns passing through both of the first tape main body portion region 22*a* and the second tape main body portion region 22*b*. Likewise, connection is made with knitting yarns passing through both of the second wale W2 of the element attachment portion 21 and the third wale W3 of the first tape main body portion region 22*a*, and connection is made with knitting yarns passing through both of the eleventh wale W11 of the second tape main body portion region 22*b* and the twelfth wale W12 of the ear portion 13.

On the other hand, the knitting structure of the element attachment portion 21 is made using the chain knitting yarn 41 (0-1/1-0) arranged in each of the first and second wales W1, W2, a first tricot knitting yarn 45 (1-0/1-2) and a second tricot knitting yarn 46 (1-2/1-0) arranged between the first and second wales W1, W2, the first and second single cord knitting yarns 42, 43 arranged in the second wale W2, and the first inserted weft yarn 44 arranged in the second wale W2.

In this case, the first tricot knitting yarn 45 and the second tricot knitting yarn 46 are inserted such that their insertion positions are displaced from each other by one course so that the first tricot knitting yarn 45 and the second tricot knitting yarn 46 cross between the courses. The first tricot knitting yarn 45 is arranged at the front surface side of the tape with respect to the core thread 25, and the second tricot knitting yarn 46 is arranged at the back surface side of the tape with respect to the core thread 25.

The element attachment portion 21 is a portion for attaching the fastener element, and is a portion including two wales, i.e., the first wale W1 and the second wale W2 located to sandwich the core thread 25.

In this case, one side edge of the tape main body portion 22 is the third wale W3 in FIG. 5, and is located adjacent to the second wale W2 of the element attachment portion 21. On the other hand, the other side edge of the tape main body portion 22 is the eleventh wale W11 in FIG. 5, and is located adjacent to the twelfth wale W12 of the ear portion 23.

The core thread 25 arranged between the first wale W1 and the second wale W2 of the element attachment portion 21 is held by being inserted between the chain knitting yarns 41 arranged in the first and second wales W1, W2 and the first and second tricot knitting yarns 45, 46 arranged between the first and second wales W1, W2.

The knitting structure of the ear portion 23 according to the second embodiment is made using the chain knitting yarn 41 (0-1/1-0) arranged in each of the twelfth and thirteenth wales W12, W13, the first and second single cord knitting yarns 42, 43 also arranged in the tape main body portion 22, and the inserted warp yarn 47 (1-1/0-0) arranged in each of the twelfth and thirteenth wales W12, W13.

In the fastener tape 20 according to the second embodiment, nylon or polyester multifilament yarns are used for constituent yarn lines arranged in the ear portion 23 (the twelfth and thirteenth wales W12, W13) other than the chain knitting yarn 41 and the inserted warp yarn 47.

In this case, yarn lines of the chain knitting yarn 41, the first single cord knitting yarn 42, the second single cord knitting yarn 43, and the first inserted weft yarn 44 arranged in the second wale W2 to the fifth wale W5 (including yarn lines at least a portion of which is inserted through at least one row of wale of the second wale W2 to the fifth wale W5) use thin yarn lines of which fineness is smaller than the constituent yarn line constituting the second tape main body portion region 22*b* (more specifically, the chain knitting yarn 41, the first single cord knitting yarn 42, and the second single cord knitting yarn 43 arranged only in the sixth wale W6 to the eleventh wale W11 (except yarn lines between the fourth and fifth wales W4, W5)). Therefore, while the flexibility of the second tape main body portion region 22*b* is ensured, the tape region ranging from the second wale W2 to the fifth wale W5 can be formed with a dense knitting structure without increasing the tape thickness.

In the second embodiment, a multifilament yarn having a fineness equal to or more than 56 deci-tex (dtex) and equal to or less than 300 deci-tex (dtex) is preferably used for the chain knitting yarn 41, the first single cord knitting yarn 42, the second single cord knitting yarn 43, and the first inserted weft yarn 44 arranged as thin yarn lines in the second wale W2 to the fifth wale W5. A multifilament yarn having a fineness equal to or more than 200 deci-tex (dtex) and equal to or less than 500 deci-tex (dtex) is preferably used for the chain knitting yarn 41, the first single cord knitting yarn 42, and the second single cord knitting yarn 43 arranged in the sixth wale W6 to eleventh wale W11 of the second tape main body portion region 22*b*.

In the fastener tape 20 according to the second embodiment, a water-soluble composite yarn having a core-sheath structure like the first embodiment explained above is used for the chain knitting yarn 41 and the inserted warp yarn 47 arranged in the ear portion 23 (the twelfth and thirteenth wales W12, W13), and the ear portion 23 is formed flexibly.

In the fastener tape 20 according to the second embodiment having such knitting structure, after knitting process is performed while the core thread 25 is knitted into the element attachment portion 21, heat treatment is applied, so that the first and second single cord knitting yarns 42, 43 and the first inserted weft yarn 44 which are arranged in the second wale W2 to the fifth wale W5 are respectively shrunk by heat.

Accordingly, the second wale W2 to the fifth wale W5 are pulled in a direction to move closer to each other, so that the interval between each of the second wale W2 to the fifth wale W5 is narrowed, and the second wale W2 to the fifth wale W5 are more closer to each other than the sixth wale W6 to the eleventh wale W11 constituting the second tape main body portion region 22*b*. At the same time, the interval between courses is narrowed in the tape region ranging from the second wale W2 to the fifth wale W5, and therefore, the size of the tape region in the tape length direction becomes shorter than the second tape main body portion region 22*b*.

Therefore, in the fastener tape 20 having been subjected to the heat treatment, the second tape main body portion region 22*b* and the ear portion 23 have appropriate flexibility, and at the same time, the tape region ranging from the second wale W2 to the fifth wale W5 has a high yarn density and formed densely, so that the tape strength of the tape region is improved. In addition, when the slide fastener is made, the abrasion resistance to the sliding movement of the slider can be improved.

In particular, as described above, yarn lines of which fineness is less than that of the constituent yarn lines constituting the second tape main body portion region 22*b* are used for the second wale W2 to the fifth wale W5 according to the second embodiment, and therefore, the tape strength of the tape region ranging from the second wale W2 to the fifth wale W5 can be further improved effectively.

Moreover, in the fastener tape 20 according to the second embodiment, the tape region having a high yarn density and formed with a dense knitting structure is widely formed from the second wale W2 to the fifth wale W5, like the first embodiment explained above. Therefore, when fastener elements are attached to the fastener tape 20, the fastener elements can be fixed to the element attachment portion 21 in a stable manner.

In the form of the fastener tape 20 according to the second embodiment to which the heat treatment has been applied, the fastener tape 20 at the side of the element attachment portion 21 shrinks, in the tape length direction, than at the side edge portion at the side of the tape which is opposite side thereto, and the entire fastener tape 20 is bent in an arc shape.

With the fastener tape 20 according to the second embodiment explained above, the fastener stringer can be made by forming fastener elements by forming a thermoplastic resin material by means of injection molding, by forming fastener elements by forming a metallic material by means of die casting, or by swaging and attaching metallic fastener elements to the element attachment portion 21.

No matter which of the means explained above is used to make the fastener stringer, the entire fastener tape 20 to which the fastener elements are attached is bent in an arch shape as described above. As a result, when the slide fastener made using the obtained fastener stringer is sewed and fixed to clothes, i.e., fastener-attached product, and the like, this can prevent waving creases from being formed on the fastener tape 20 and the clothes.

Further, when the fastener stringer is made by forming the thermoplastic resin material on the fastener tape 20 according to the second embodiment by means of the injection molding or by forming the metallic material on the fastener tape 20 according to the second embodiment by means of the die casting, this prevents molten resin or the molten metal from leaking through the gaps between the wales and the knitted loops of the fastener tape 20 (leakage), and prevents the molten resin or the molten metal from leaking to the tape main body portion 22 and making the tape main body portion 22 rigid, like the first embodiment explained above.

Two fastener stringers 1 obtained using the fastener tape 20 according to the second embodiment are made into a pair, whereby the slide fastener is made. Therefore, a slide fastener having a high degree of tape strength against the sideway pulling force and a high degree of abrasion resistance against the sliding movement of the slider can be obtained.

DESCRIPTION OF REFERENCE NUMERALS

1 fastener stringer
2 fastener element
3 slide fastener
4 slider
4*a* flange
10 fastener tape
11 element attachment portion
12 tape main body portion
12*a* first tape main body portion region
12*b* second tape main body portion region
13 ear portion
15 core thread
20 fastener tape
21 element attachment portion
22 tape main body portion
22*a* first tape main body portion region
22*b* second tape main body portion region
23 ear portion
25 core thread
31 chain knitting yarn
32 tricot knitting yarn
33 first inserted weft yarn
34 second inserted weft yarn
35 inserted warp yarn
36 third inserted weft yarn
37 fourth inserted weft yarn
41 chain knitting yarn
42 first single cord knitting yarn
43 second single cord knitting yarn
44 first inserted weft yarn
45 first tricot knitting yarn
46 second tricot knitting yarn
47 inserted warp yarn

The invention claimed is:

1. A slide fastener including:

a left-right pair of fastener stringers, wherein each fastener stringer comprises:

a fastener tape including a tape main body portion having a warp knitting structure;

an element attachment portion knitted along one side edge of the tape main body portion into which a core thread is knitted;

a fastener element made of synthetic resin fixed at the element attachment portion by injection molding or a metallic fastener element fixed at the element attachment portion by die cast molding; and a slider which is slidably attached along element rows on the fastener stringers, wherein the element rows are formed of a plurality of the fastener elements, wherein the tape main body portion includes a first tape main body portion region arranged at a side of the element attachment portion and having a plurality of rows of wales and a second tape main body portion region arranged from a wale adjacent to the first tape main body portion region to an other side edge of the tape main body portion, the first tape main body portion region includes a flange pass region on which a flange of the slider passes, and a wale interval between a wale of the element attachment portion adjacent to the first tape main body portion region and a wale constituting the first tape main body portion region being narrower than a wale interval between wales constituting the second tape main body portion region.

2. The slide fastener according to claim 1, wherein a heat-shrinkable yarn having heat shrinking property is arranged through two or more rows of wales in the wale of the element attachment portion adjacent to the first tape main body portion region and the wale constituting the first tape main body portion region, and a heat shrinking rate of the heat-shrinkable yarn is set at a level higher than that of a yarn arranged through two or more rows of wales in a wale constituting the second tape main body portion region.

3. The slide fastener according to claim 1 including a first inserted weft yarn which is inserted through the wale of the element attachment portion adjacent to the first tape main body portion region and at least two or more rows of wales arranged in the first tape main body portion region at the side of the element attachment portion.

4. The slide fastener according to claim 3 including a second inserted weft yarn which is inserted in a direction crossing the first inserted weft yarn between courses and is arranged through the wale of the element attachment portion adjacent to the first tape main body portion region and at least two or more rows of wales of the wales constituting the first tape main body portion region.

5. The slide fastener according to claim 4 including an inserted warp yarn which is inserted into each wale constituting the first tape main body portion region.

6. The slide fastener according to claim 5 including:

a first single cord knitting yarn which is inserted through the wale of the element attachment portion adjacent to the first tape main body portion region and at least three or more rows of wales of the wales constituting the first tape main body portion region; and a second single cord knitting yarn which is inserted in a direction crossing the first single cord knitting yarn between courses and is arranged through the wale of the element attachment portion adjacent to the first tape main body portion region and at least three or more rows of wales of the wales constituting the first tape main body portion region.

7. The slide fastener described in claim 5, wherein the wale of the element attachment portion adjacent to the first tape main body portion region and one of the wales constituting the first tape main body portion region is arranged with a yarn line of which fineness is less than that of a constituent yarn line constituting the second tape main body portion region.

8. The slide fastener according to claim 2 including a first inserted weft yarn which is inserted through the wale of the element attachment portion adjacent to the first tape main body portion region and at least two or more rows of wales arranged in the first tape main body portion region at the side of the element attachment portion.

* * * * *

UNITED STATES PATENT AND TRADEMARK OFFICE

CERTIFICATE OF CORRECTION

PATENT NO. : 8,916,255 B2
APPLICATION NO. : 13/637726
DATED : December 23, 2014
INVENTOR(S) : Syuji Wakata et al.

It is certified that error appears in the above-identified patent and that said Letters Patent is hereby corrected as shown below:

In the Specification

In column 13, line 51, delete “structure:” and insert -- structure is --, therefor.

In column 16, line 24, delete “tapestrength” and insert -- tape strength --, therefor.

Signed and Sealed this
Fifth Day of May, 2015

Michelle K. Lee

Michelle K. Lee
*Director of the United States Patent and Trademark Office*